US005690025A

United States Patent [19]

Hawkins

[11] Patent Number: 5,690,025

[45] Date of Patent: Nov. 25, 1997

[54] TRASH RECEPTACLE AND COMPACTOR FOR USE IN PUBLIC AREAS AND METHOD

[76] Inventor: Bobby Leonard Hawkins, 2 Manley Rd., Travelers Rest, S.C. 29690

[21] Appl. No.: 586,405

[22] Filed: Jan. 16, 1996

[51] Int. Cl.[6] ..... B30B 9/30

[52] U.S. Cl. ..... 100/35; 100/229 A; 100/245; 100/269.07

[58] Field of Search ..... 100/35, 214, 229 A, 100/245, 266, 269.07, 269.17

[56] References Cited

U.S. PATENT DOCUMENTS

| | | | |
|---|---|---|---|
| 3,838,635 | 10/1974 | Hardy | 100/229 A |
| 3,901,139 | 8/1975 | Moriconi | 100/269.17 |
| 3,903,790 | 9/1975 | Gladwin | 100/229 A |
| 4,073,228 | 2/1978 | Henzl | 100/269.07 |
| 4,147,100 | 4/1979 | Dykstra | 100/269.07 |
| 4,603,626 | 8/1986 | Nall et al. | 100/229 A |
| 5,042,374 | 8/1991 | Klepacki | 100/229 A |
| 5,448,945 | 9/1995 | Taylor et al. | 100/229 A |
| 5,517,907 | 5/1996 | Fox | 100/229 A |

FOREIGN PATENT DOCUMENTS

| | | | |
|---|---|---|---|
| 2591202 | 6/1987 | France | 100/229 A |

*Primary Examiner*—Stephen F. Gerrity
*Attorney, Agent, or Firm*—Ralph Bailey

[57] ABSTRACT

A low profile trash receptacle housing carries a plurality of vertically and horizontally spaced hydraulic cylinders (A) and (B) for incrementally and simultaneously supplying a downward stroke upon a horizontally disposed compaction plate (C) so that upon retraction of the compaction plate and cylinders to a raised position following a compacting cycle adequate space is provided so that a door (D) may be opened to extend inwardly for reception of trash into a lower compacting portion of the housing with guides (E) providing stability to the compaction plate at all times during the compacting cycle.

14 Claims, 3 Drawing Sheets

Fig. 4.
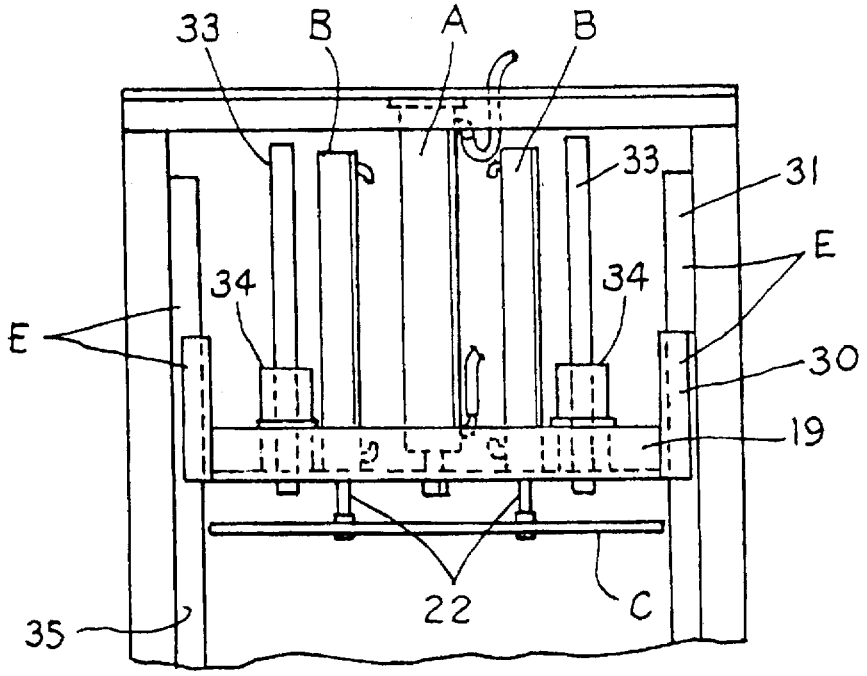
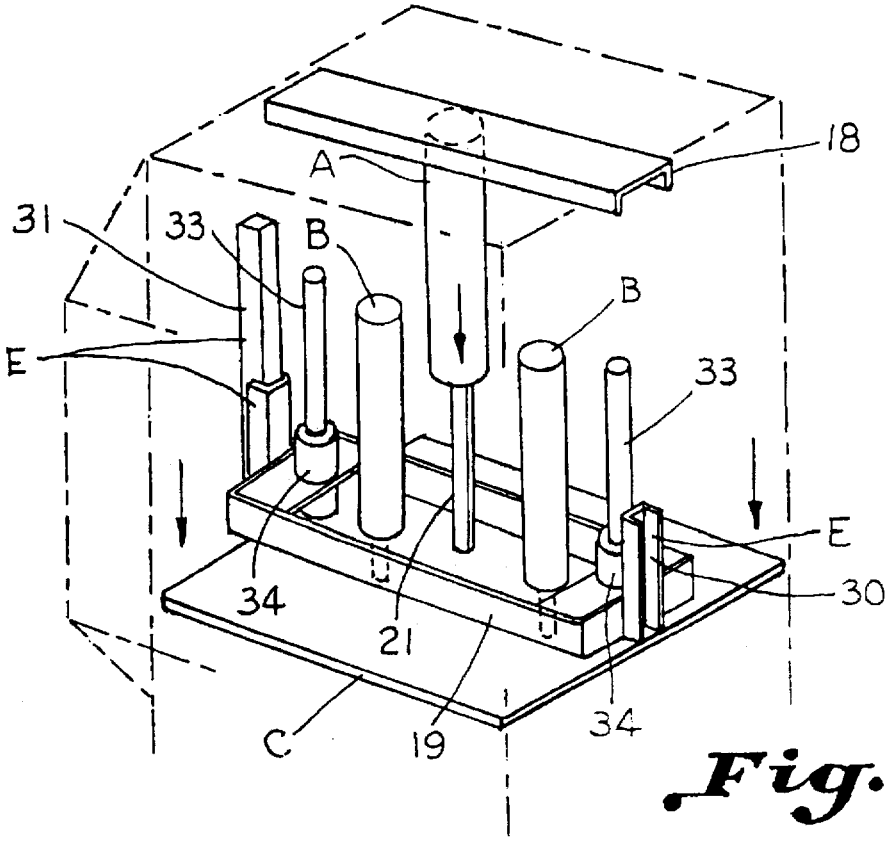
Fig. 5.

TRASH RECEPTACLE AND COMPACTOR FOR USE IN PUBLIC AREAS AND METHOD

BACKGROUND OF THE INVENTION

This invention relates to improved trash receptacles and methods for use in public areas such as restaurant dining areas, parks, buildings and the like which also serve for compacting the trash received in the receptacles.

Efforts to solve the problems of supplying combination trash receptacles and compactors have contemplated apparatus disclosed in U.S. Pat. No. Re. 33,527. Because the power strokes of such apparatus must be relatively long to compact bulky trash such as paper cups, plates, napkins, etc. of the type generated in fast food dining areas and the like, a cylinder which is commensurate in length is required for exerting a compacting stroke. The patent discloses compactors having essentially three compartments of like size, i.e. an upper compartment devoted to containing apparatus for supplying power for compaction, an intermediate compartment for receiving trash and a compartment for compaction in a lower portion of the housing.

Efforts to reduce the height of the required housing have included the provision of a collection and compaction device Model 2001 Self-Service Compactor by TFC Corporation of Minneapolis, Minn. wherein a fold-up compactor plate is mechanically operated by cams so as to allow low compactor profile as well as ample clearance for waste in accordance with U.S. Pat. No. 5,517,907. The compaction plate folds up so as to permit a door pivoted about an upper edge in the housing to open providing clearance for the passage of trash deposits beneath the compaction plate into a lower compaction compartment.

Such devices may present problems in the mechanical functioning of the fold-up plate wherein the cam mechanism for automatically folding up the compactor plate to facilitate the reception of trash and for returning same to horizontal operating position for a compaction stroke may not function properly because of wear. Such apparatus is complicated and expensive.

SUMMARY OF THE INVENTION

Accordingly, it is an important object of the invention to provide an improved trash receptacle and compactor which has a low profile as well as ample clearance for waste deposits through the use of an improved power operated mechanism for imparting compacting force to the compaction plate while permitting the plate to be raised to such an extent when retracted that ample space is afforded for the passage of trash deposits into a lower portion of the housing for compaction without substantially increasing the height of the trash receptacle.

Another important object of the invention is the provision of a power operated means for a trash receptacle and compactor having a low profile and which is retractable to an extent that its height is less than the length of the compacting stroke while requiring a minimum of mechanical parts.

Another important object of the invention is the provision of a plurality of hydraulic cylinders supplying incremental portions of the power stroke of the compaction plate permitting retraction thereof in an amount greater than the length of the compacting stroke.

Another important object of the invention is a reduction in compaction cycle time through the use of power operated means including a plurality of hydraulic cylinders providing simultaneously incremental parts of the power stroke capable of operation in less time than is required for a single hydraulic cylinder to supply the full stroke.

It has been found that by providing power operated means which in its retracted position presents a low profile above a compaction plate, which is maintained at all times in its fully operatable horizontal position and yet is sufficiently elevated upon retraction to permit the operation of an inwardly pivoted door for receiving trash, an efficient trash receptacle and compactor may be constructed. The method contemplates retracting the compactor plate to such an extent that the height of power operating mechanism therefor when retracted is less than the length of the power stroke, while guiding the compactor plate at all times during the power stroke to provide greater stability.

Compaction cycles or strokes may be successively carried out after a predetermined number of trash deposits are made in order to assure that ample space for additional deposits is available at all times.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 4 is a front elevational view further illustrating the power operated means of the present invention and its structural relationship to the compaction plate for conserving space when in fully retracted position FIG. 5 is a perspective view with the power operated means in a position where one of the stages of the cylinders is in a fully extended position carrying a mounting for a second pair of cylinders with sequential guidance means for purposes of illustration and FIG. 6 is a perspective view illustrating the parts in fully lowered position on a compacting stroke.

DESCRIPTION OF A PREFERRED EMBODIMENT

The drawings illustrate a trash compactor for use in a public area such as a restaurant dining area having a substantially rectangular upright housing. A generally horizontal support forms an upper portion of the housing carrying a cylinder assembly including a plurality of hydraulic cylinders A and B depending from the support and being extensible downwardly for exerting a downward compacting force. A generally horizontally disposed compaction pate C is carried by a lower end of the cylinder assembly. A door D in the housing is pivotally carried so as to extend inwardly with the cylinder assembly in retracted position, providing a passageway of sufficient size to permit passage of trash beneath the compaction plate into the housing. Vertical guides E align the compaction plate for downward movement on a compaction stroke responsive to the downward compacting force exerted by the cylinder assembly upon the compaction plate. Suitable retracting means return the compaction plate to raised position upon completion of a compacting stroke. Thus, a low profile compactor may provide compacting force as the compaction plate is lowered and a passageway for trash is provided therebeneath when the cylinder assembly is retracted to raised position.

The method contemplates applying downward compacting forces by extending hydraulic cylinders simultaneously supplying a compacting stroke incrementally and retracting the cylinders so that the height and cycle time of the compactor may be reduced.

Figure 1:
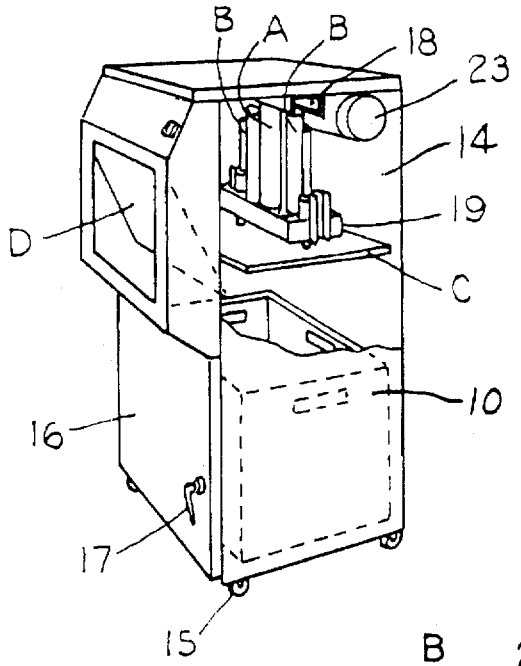
FIG. 1 is a right perspective view with parts broken away illustrating an upright housing constructed in accordance with the invention carrying a trash receiving door which is pivoted to swing inwardly about an upper edge and containing the power operated means for delivering power to a rigid compaction plate which remains in horizontal operating position at all times for compacting trash in a lower portion of the housing.
Figure 2:
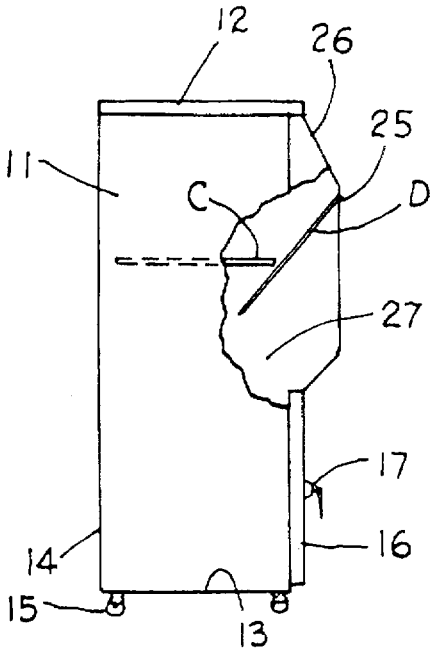
FIG. 2 is a side elevational view looking toward the left side of the housing illustrated in FIG. 1, with parts broken away, to illustrate the position of the door for receiving trash below a compaction plate when in retracted position.
Figure 3:
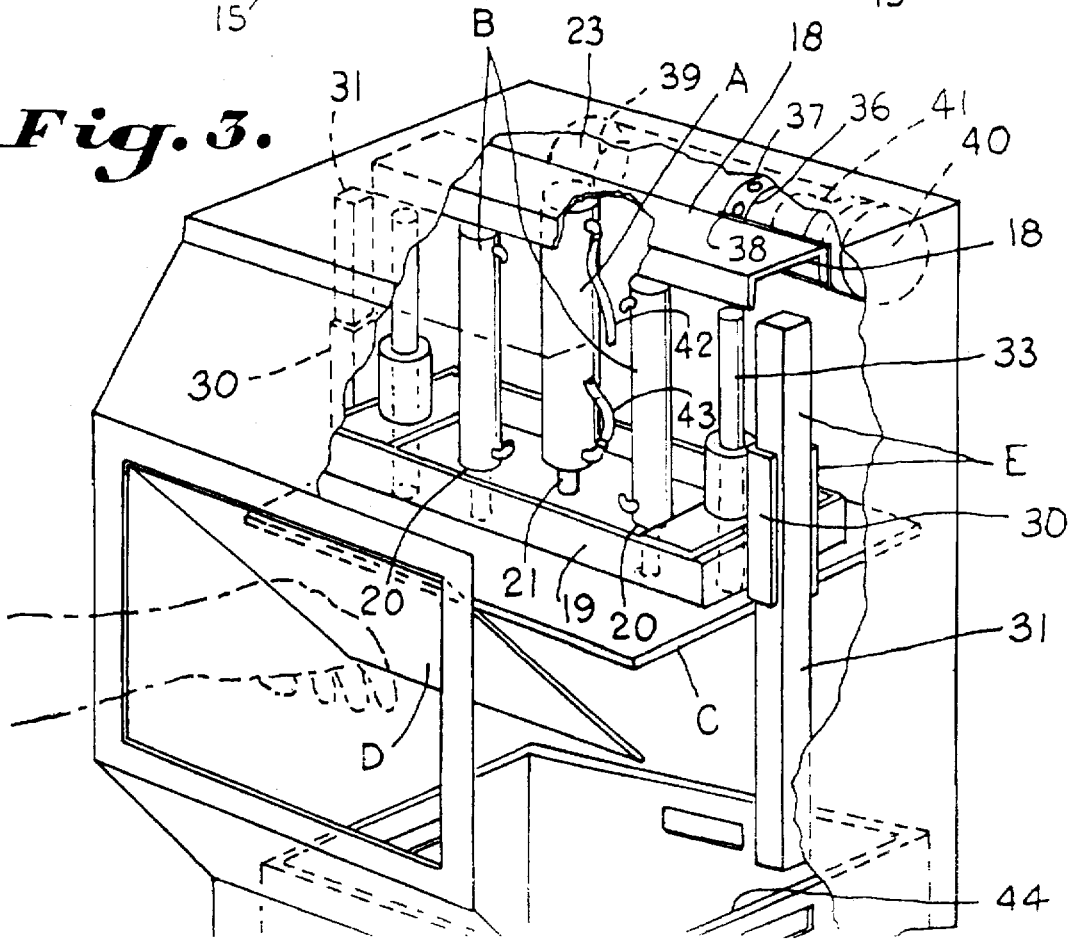
FIG. 3 is a perspective view further illustrating power-operating means constructed in accordance with the present invention at an enlarged scale with the door in open position so as to extend inwardly beneath the compaction plate in raised retracted position upon completion of a compacting stroke for passage of trash therebeneath and preparatory to commencement of another compaction stroke

Referring more particularly to FIGS. 1 and 2, a substantially rectangular housing includes opposed planar sides 10 and 11, carrying a top 12 constituting an upper tray receiving table for stacking trays thereon, and a bottom 13. A planar rear panel 14 encloses the back of the housing. The housing is preferably supported by suitable casters 15 which are illustrated as being carried adjacent each corner of the housing. A lower portion of the housing includes a hinged door 16 having a handle 17 for opening the door into a compaction area. The upper tray receiving table is in alignment with an upper support 18 at the top of the lasting from which a hydraulic cylinder A is suspended. The cylinder A has a fixed connection at a lower end on a movable intermediate support 19 by means of piston rod 21 (FIG. 3). A pair of transversely spaced cylinders B have fixed connection at their lower ends as at 20 on the intermediate support 19 and each has a piston rod 22 (FIGS. 4 and 6) having fixed connection at its free end to the compaction plate C.

The compaction plate C is illustrated in raised position in FIGS. 1, 2, 3 and 4 and is supplied with hydraulic fluid under suitable pressure from an assembly 23 which is fixedly carried in an upper portion of the housing upon the support 18.

Referring more particularly to FIGS. 1–3, the housing is illustrated as carrying a door D which is pivotally mounted as by a horizontal hinge 25 at its upper edge in an upper outwardly extending portion of the housing which is illustrated as at 26. The door is best illustrated in FIGS. 2 and 3 as extending beneath the compaction plate C when in raised retracted position. It will be noted that a passageway 27 is thus provided to supply sufficient room for passage of trash beneath the compaction plate C. This space is augmented by the outward rectangular extension 26 of the housing to supplying additional room for the opening of the door D beneath the compaction plate C.

Figure 6:
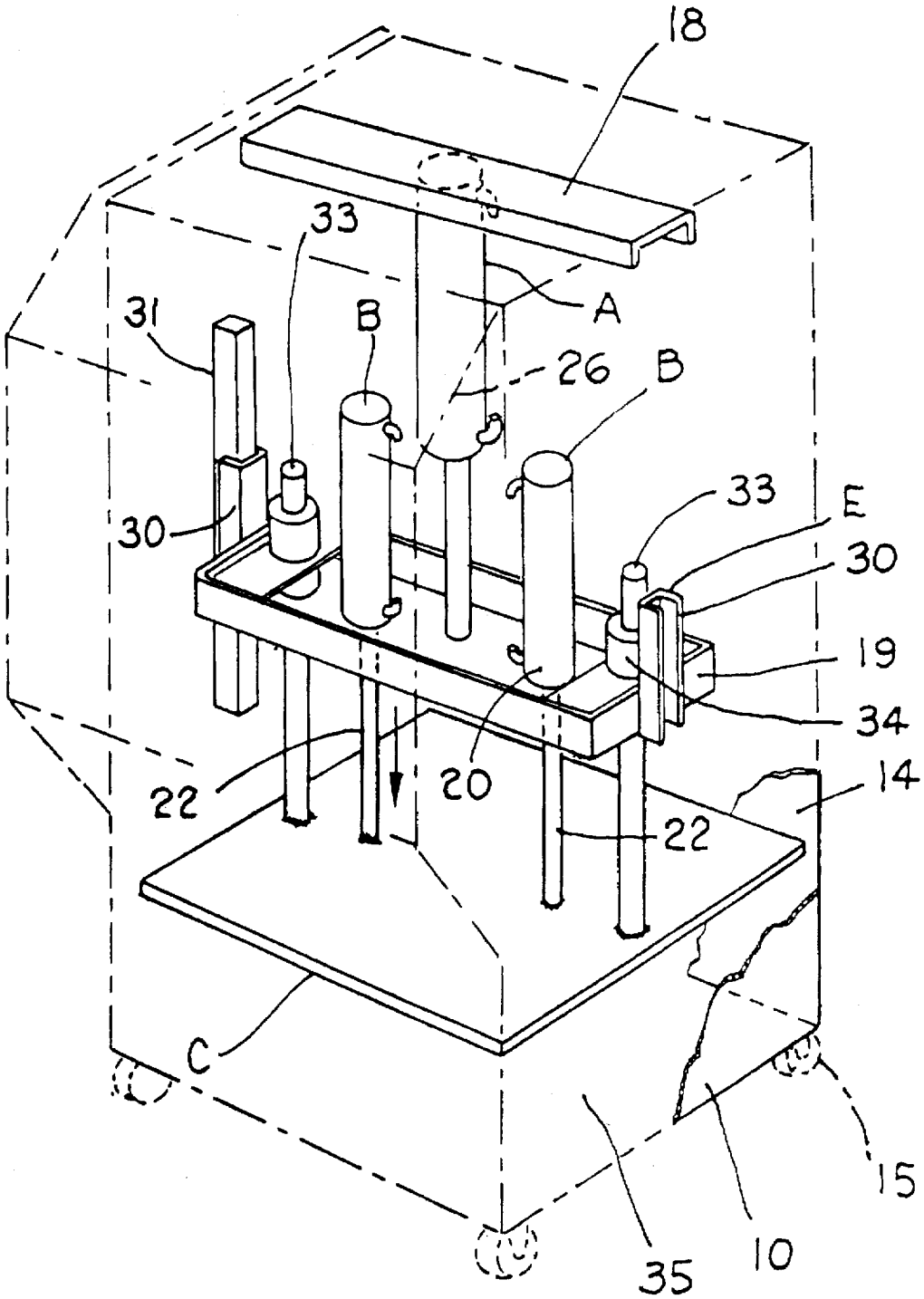

Referring more particularly to FIGS. 3–6, guide means E for stabilizing the compaction plate on a compaction stroke are illustrated as including a pair of vertical opposed slides 30 which carry the intermediate support 19 for vertical sliding movement. Vertical trackways 31 receive and carry each of the slides. FIG. 5 illustrates the components in an intermediate position wherein the larger of the cylinders A has its piston rod 21, fixed to the intermediate support 19, fully extended. In FIG. 6 each of the smaller transversely spaced cylinders B and piston rods 22 are also fully extended. The vertical guides E further include a pair of transversely spaced rods 33 carried upwardly beside the cylinders B extending upwardly through respective sleeves 34 carried on the intermediate support 19. These intermediate guides serve to stabilize the compaction plate C on its stroke into the compacting compartment 35 (FIG. 6) in the lower part of the housing.

While the stages in the compaction stroke have been illustrated in the drawings as being successive preferably these stages are carried out simultaneously in order to reduce cycle time. The cycle time is reduced because pressurized fluid is supplied to the cylinders simultaneously. These stages when activated simultaneously require less time to cycle such that the total time would be less than the time required by a cylinder of a length commensurate with the length of the compaction stroke.

FIG. 3 schematically illustrates the components of the hydraulic assembly 23 which provides hydraulic fluid under pressure to the cylinders A and B. A valve 36 having connections 37 and 38 is positioned between a motor 39 and a reservoir 40 containing a pump 41. An upper end of the cylinder A is connected to high pressure outlet connection 37 through a suitable flexible line 42 while the lower end of the cylinder A has connection through the line 43 to the connection 38 which acts as a return during a downward power stroke of the compactor plate C. Likewise the upper ends of the cylinders B are connected through suitable flexible hydraulic lines (not shown) to the upper end of the cylinder A. The lower ends of the cylinders B are suitably connected to the lower end of the cylinder A for simultaneous action of all the cylinders on a power stroke. On a return stroke pressurized fluid is introduced at a lower end of the cylinders and returned to the reservoir from the respective upper ends.

An open topped box is illustrated at 44 for holding a trash receiving container in a lower compactor compartment 35. Lower ends of the guide tracks 31 serve to prevent the box 44 from becoming displaced upwardly on a return stroke by the action of the withdrawal of the compactor plate C.

It is thus seen that an improved low profile trash compactor having adequate space to receive trash beneath a compaction plate when in raised retracted position has been provided. While vertically and horizontally spaced hydraulic cylinders have been described and illustrated, other power operated means including telescoping cylinders, hydraulically operated scissors linkage and driven screw threaded elements may be employed to actuate a compacting stroke of a compaction plate such that in a retracted position less vertical storage space is required than that which would be required by a cylinder of the full length of the compacting stroke.

An important advantage is achieved by the improved trash receptacle and compactor in that a lesser number of trash receptacles need be utilized to meet the trash disposal requirements of a restaurant thus reducing the requirements for floor space in new restaurants and increasing the available floor space in existing restaurants. The requirements for collection bins are also reduced because of the reduced volume of waste resulting from compaction.

While a preferred embodiment of the invention has been described using specific terms, such description is for illustrative purposes only, and it is to be understood that changes and variations may be made without departing from the spirit or scope of the following claims.

What is claimed is:

1. A trash receptacle and compactor for use in a public area comprising:

a substantially rectangular upright housing;

a generally horizontal support fixed in an upper portion of said housing;

an assembly including a plurality of hydraulic cylinders carried by said generally horizontal support, said hydraulic cylinders being extensible downwardly for exerting a downward compacting force in increments creating a compaction stroke of greater length than the stroke of any single cylinder;

said assembly further including a generally horizontally disposed rigid compaction plate carried at a lower end of said assembly;

a compacting compartment beneath and in vertical alignment to receive said rigid compaction plate;

a trash entry door in said housing pivoted so as to extend inwardly when in opened position and with said cylinders in retracted position providing a passageway below said compaction plate of sufficient size to permit passage of trash directly beneath said compaction plate into said compacting compartment;

a pivotal connection for said door about a horizontal upper edge above said compaction plate when in raised retracted position so as to be inclined inwardly when opened and said compaction plate is in said raised retracted position forming said passageway for trash beneath said compaction plate;

spaced vertical guides for aligning said compaction plate for downward movement on a compaction stroke responsive to said downward compacting force exerted by said cylinders upon said compaction plate;

the spaced vertical guides include a vertical trackway guiding a movable support carrying said compaction plate during a power stroke, and a pair of vertical rods carried by said compaction plate and said movable support for guiding said compaction plate; and retracting means for returning said cylinders and compaction plate to raised position upon completion of a compaction stroke;

whereby a low profile compactor may provide compacting force in increments of lesser length than the compaction stroke as the compaction plate is lowered as well as affording a passageway for trash beneath the compaction plate when the cylinders are retracted to bring the compaction plate to raised position.

2. The structure set forth in claim 1 wherein said door extends beneath said compaction plate when opened; and a trash container receivable in said compacting compartment.

3. The structure set forth in claim 1 wherein an upper front portion of said housing extends outwardly of a lower compacting portion of said housing containing said door to provide increased space for the passage of trash beneath said compaction plate.

4. The structure set forth in claim 1 wherein said cylinders are double acting for exerting force both for said compaction stroke and for returning the compaction plate to said raised position.

5. The structure set forth in claim 1 wherein said cylinders are staggered in relation to said compaction plate to supply an axial force for exerting said compaction stroke.

6. The structure set forth in claim 5 wherein each of said cylinders act simultaneously on a power stroke.

7. The structure set forth in claim 5 wherein a first cylinder is carried between said fixed support and said movable support, and a second cylinder in staggered relation to said first cylinder is carried between said movable support and said compaction plate.

8. The structure set forth in claim 7 wherein at least two cylinders in staggered relation with another cylinder at a next level are included in said assembly.

9. The structure set forth in claim 1 including an upper tray receiving table on said housing above and in alignment with said horizontal support.

10. The method of collecting and compacting trash in a public area comprising the steps of:

providing an upright trash receiving housing;

positioning a generally horizontally disposed power operated assembly including a movable support and a compaction plate depending therefrom for vertical movement in said housing for compacting trash in a lower compacting compartment in vertical alignment therewith;

hinging a trash receiving door for pivotal movement in said housing which, when pivoted to open position with said compaction plate in raised retracted position extends inwardly beneath said compaction plate providing a passageway of sufficient size to permit passage of trash directly beneath said compaction plate into said compacting compartment;

guiding and positioning said power operated assembly on a vertical trackway during application of compacting force and during retraction to raised position; and guiding and positioning said compaction plate for vertical movement in respect to said movable support; and exerting a compaction stroke of such length as to compact said trash in the lower compacting compartment by incremental movements between said horizontal support, said movable support and said compaction plate;

whereby a low profile compactor may provide for the introduction of trash beneath the compaction plate when in raised retracted position.

11. The method set forth in claim 10 including the step of supplying hydraulic fluid for simultaneously actuating a plurality of spaced hydraulic cylinders included in said assembly for exerting said compaction stroke in increments.

12. The method set forth in claim 11 including the step of continuously guiding said compaction plate on spaced vertical guides during said compacting stroke and during retracting of said compaction plate to raised position.

13. The method set forth in claim 12, including the step of extending a portion of said housing outwardly of said compaction plate and hinging said door therein about a horizontal upper edge to enlarge a space below said compaction plate forming a passageway for reception of trash.

14. The method set forth in claim 10 including the step of supplying hydraulic fluid for sequentially actuating a plurality of spaced hydraulic cylinders included in said assembly for exerting said compaction stroke in increments.

* * * * *